United States Patent [19]

Gale et al.

[11] 4,004,889

[45] Jan. 25, 1977

[54] POWDERED METAL ARTICLE HAVING WEAR RESISTANT SURFACE

[75] Inventors: Preston Lee Gale, East Peoria; James L. Roberts, Chillicothe, both of Ill.

[73] Assignee: Caterpillar Tractor Co., Peoria, Ill.

[22] Filed: Oct. 6, 1975

[21] Appl. No.: 619,880

[52] U.S. Cl. ..... 29/182.2; 75/208 R; 148/126

[51] Int. Cl.[2] ..... B22F 7/04

[58] Field of Search ..... 29/182.2 , 182.1; 75/208 R, 200; 148/126

[56] References Cited

UNITED STATES PATENTS

| | | | |
|---|---|---|---|
| 3,668,951 | 6/1972 | Talmage | 29/182.2 |
| 3,802,852 | 4/1974 | Niimi et al. | 29/182.1 |
| 3,863,318 | 2/1975 | Niimi et al. | 29/182 |

FOREIGN PATENTS OR APPLICATIONS

| | | |
|---|---|---|
| 1,161,663 | 8/1969 | United Kingdom |
| 1,164,289 | 9/1969 | United Kingdom |
| 892,770 | 3/1962 | United Kingdom |

*Primary Examiner*—Brooks H. Hunt
*Attorney, Agent, or Firm*—Phillips, Moore, Weissenberger, Lempio & Strabala

[57] ABSTRACT

A powdered metal article having a fused wear resistant coating thereon is described. Specific embodiments of such article are disclosed including a specific powdered metal and a specific coating together with specific structural relationships therebetween. A method of making articles according to the teaching of this invention is described.

8 Claims, 5 Drawing Figures

POWDERED METAL ARTICLE HAVING WEAR RESISTANT SURFACE

BACKGROUND OF THE INVENTION

This invention relates to powdered metal parts and more particularly to a powdered metal article having a wear resistant coating thereon.

It is known in the art to make parts for various structures and machines by subjecting a powdered metal to heat and pressure to compact it into an essentially solid body which may be of the desired size and shape or may be subsequently machined or otherwise formed into the desired size and shape. Such parts have many advantages in particular applications since a wide range of physical characteristics may be designed into the powdered metal bodies comprising such parts.

In other words, the powdered metal or mixture of powdered metals which are compacted to form the bodies of which such parts are made, can be selected to provide physical characteristics not obtainable through the use of solid alloys of metals. In addition, the mechanical nature of the bodies, since they consist of a mass of powder particles bonded to each other with minute voids therebetween rather than a solid solution of the constituents of the powdered metal particles provide physical characteristics that are highly desirable for certain applications.

Although powdered metal articles exhibit good mechanical strength, they are subject to excessive wear in use and are easily weakened by subjection to excessive heat or temperature gradients. Furthermore, it has been difficult, if not impossible to provide composite powdered metal articles having special surface characteristics different from the remainder of the body since other metals could not be successfully bonded to the surfaces of powdered metal articles.

Attempts to apply fused metallic coating to the surface of powdered metal articles through the use of heat have failed where the melting temperature of the metal to be applied is too high, since the required heat will weaken the powdered metal article and may actually cause it to crumble or fall apart. Where the melting temperature of the metal to be applied is too low, then the resulting surface coating will not have sufficient hot strength to be useful in many of the applications in which powdered metal articles may be used with advantage. Attempts to find a compromise between these two extremes have failed due to the excessive absorption of the coating metal into the volume of the powdered metal article by a capillary action which causes the coating metal to permeate the volume of the body through the voids between the powdered metal particles when the temperature of the body approaches that required to melt the coating metal. Excessive absorption of the coating metal will not only modify the desired physical characteristics of the powdered metal article but will also make it difficult to obtain the desired thickness of surface coating in addition to requiring the use of an excessive amount of coating metal which is often expensive.

It is a general object of this invention to provide a powdered metal article with a wear resistant surface of fused metal which is firmly bonded to the surface of the powdered metal article without excessive penetration into the volume of the powdered metal body.

It is a specific object of this invention to provide an engine valve seat insert comprising a body of pressed, sintered and heat-treated metal alloy powder with a wear-surface of a fused heat resistant alloy bonded thereto.

SUMMARY OF THE INVENTION

Briefly, according to this invention, a metal article comprising a body of pressed, sintered and heat-treated metallic powder of a first metal or metal alloy having a given melting temperature is provided with a fused metal wear-surface of a second metal or metal alloy having a melting temperature approaching said given melting temperature. The body has minute voids between the particles of metalic powder and portions of the fused metal of the wear-surface are received within such voids at the surface of the body to bond the wear-surface thereto without substantial alloying between the fused metal of the wear-surface and the particles of metallic powder of which the body is made.

BRIEF DESCRIPTION OF THE DRAWING

The foregoing and other objects and features of the subject invention will be more fully understood from the following detailed description of preferred embodiments taken in conjunction with the drawing wherein.

DETAILED DESCRIPTION OF PREFERRED EMBODIMENTS

Figure 1:
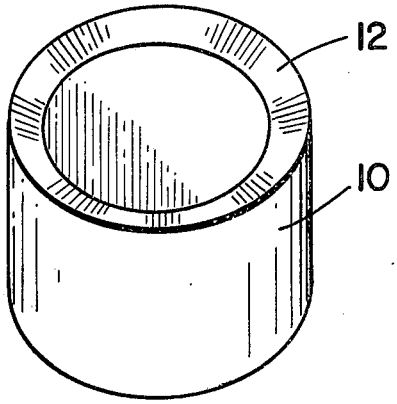
FIG. 1 is a perspective view of a powdered metal article in the form of a tubular valve insert member having a beveled upper edge which is provided with a wear resistant surface in accordance with the teaching of this invention.

Referring to FIG. 1, a powdered metal article 10 in the form of a hollow cylindrical valve seat insert is shown. The upper surface 12 is beveled to provide the desired valve seat with the remainder of the body 10 adapted to be suitably mounted in an engine block. It will be understood that the surface 12 will be exposed to high-temperature gases in operation as well as to wear by the valve member which will be alternately compressively held against the surface 12 to prevent the passage of gases and raised from the surface 12 to allow the passage of gases in operation.

The body 10 is a high density sintered structural part made by the powdered metallurgy process from pre-mixed or pre-alloyed powders comprising iron, nickel and molybdenum to which a controlled amount of carbon has been added. According to powdered metallurgy processes known in the prior art, the pre-mixed or pre-alloyed powders are compacted at high heat and pressure and subsequently heat-treated to provide a body having pre-selected mechanical and physical properties. The particles of the powders are not melted in their entirety when they are compacted under heat and pressure to form the body 10. Instead, abutting surfaces of the particles are caused to fuse with each other by the combination of heat and pressure to form a relatively high density body but one which may have a porosity approaching 10% between the particles and uniformly distributed throughout the matrix.

Although proper selection of the pre-mixed or pre-alloyed powders and the heat and pressure under which they are compacted can provide a body 10 having desired mechanical and physical properties over-all, the surface 12 of such body is peculiarly subject to wear, particularly at high temperatures. Thus, it would be desirable to provide a coating on the surface 12 which would be more resistant to wear at high temperatures than the remainder of the body 10. For example, a fused coating of a metal or metal alloy having a high melting temperature and appropriate wear resistance characteristics firmly bonded to the surface 12 is highly desirable.

In the prior art, it was substantially impossible to provide such a fused coating on the surface 12 since the exposure of the body 10 to temperatures high enough to melt desirable coating materials would tend to destroy the bonds between the particles thereof causing the body 10 to crumble or actually fall apart. Attempts to use coating materials of metal alloys having lower melting temperatures but still exhibiting useful "hot" strength have also failed due to the fact that excessive amounts of such coating materials would be absorbed into the body 10 by a capillary action which occurs at high temperatures due to the porosity of the body 10. The absorption of the coating material into the body 10 will, of course, produce undesirable changes in the mechanical and physical properties of the body 10 in addition to making the thickness of such coating difficult to control and requiring an excessive amount of coating material for a given thickness of coating.

Figure 2:
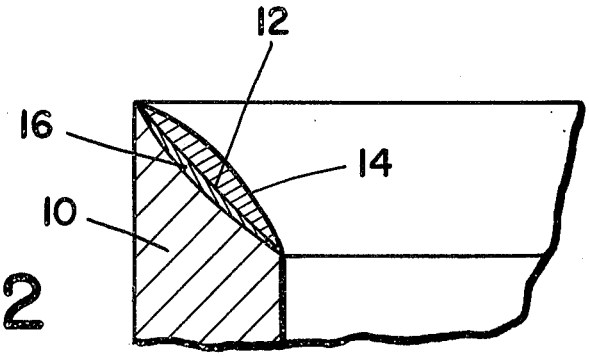
FIG. 2 is an enlarged fragmentary cross-sectional view of the valve insert member of FIG. 1 showing the wear resistant surface as applied thereto in the apparatus of FIG. 1.

According to this invention, a powdered metal article having a wear resistant surface firmly bonded thereto without appreciable change in the mechanical and physical properties of the article as a whole is provided. Referring to FIG. 2 of the drawing, the wear resistant surface 14 comprises a fused metal having a melting temperature approaching the melting temperature of the metal or metal alloy comprising the particles of the powdered metal body 10. The fused metal of the wear resistant surface 14 is received within the voids between the powder particles of the body 10 in a zone 16 immediately adjacent the surface 12 of the powdered metal body 10 without substantial alloying with such particles to provide an essentially mechanical bond between the wear resistant surface 14 and the surface 12 of the body 10.

Figure 3:
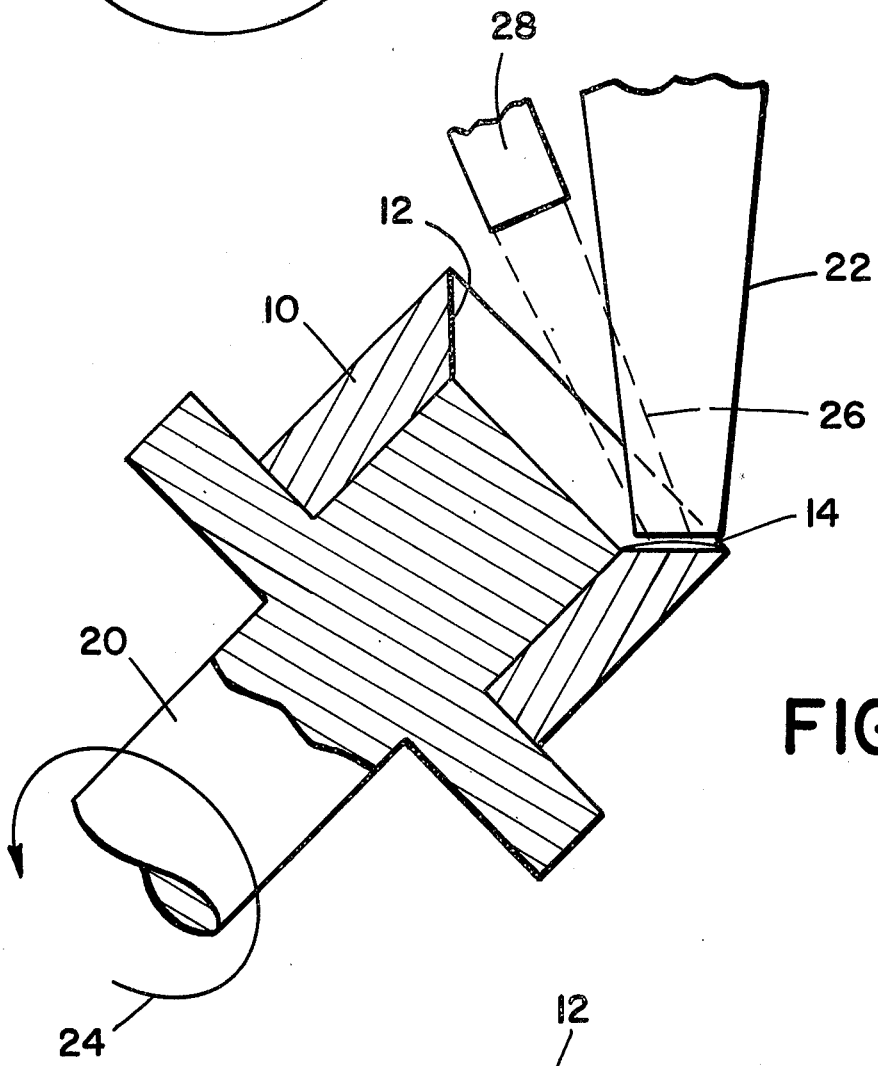
FIG. 3 illustrates apparatus suitable for use in providing the valve insert body of FIG. 1 with a wear resistant surface, the valve insert body and a portion of the apparatus being shown in fragmentary cross-section with a fragmentary showing of a funnel member and a laser positioned for use in accordance with the teaching of this invention.

The structure of the powdered metal article according to this invention will be more fully understood from a consideration of FIG. 3 of the drawing which shows a method of making such article. As shown in FIG. 3, the powdered metal body 10 is supported on a rotatable mandrel 20 with its axis extending at an angle to the vertical. The orientation of the body 10 on the mandrel 20 is such that the lowermost portion of the surface 12 thereof extends essentially horizontally and a funnel member 22 is positioned vertically over such lowermost portion of the surface 12. A powder of the metal or metal alloy to be fused to form the wear resistant surface 14 is introduced into the funnel member 22 from a supply thereof not shown in FIG. 3. The restricted open end of the funnel member 22 is positioned in close proximity to the surface 12 such that an amount of the powdered metal sufficient to cover the surface 12 is metered from the funnel member 22 upon rotation of the mandrel 20 as indicated by the arrow 24 to thereby rotate the body 10 moving the surface 12 thereof under the funnel member 22.

A high power beam of coherent electromagnetic energy indicated by the dotted lines 26 in FIG. 3 is impinged upon the metal powder deposited on the surface 12 by the funnel member 22 immediately after such powder is carried from under the funnel member 22 by rotation of the body 10 on the mandrel 20. The beam 26 of coherent electromagnetic energy may be provided by a high power laser indicated generally at 28 and which includes optical means for focusing the beam 26 to provide a cross-sectional dimension approaching the cross-sectional length of the surface 12 of the body 10. The spacing between the restricted opening of the funnel member 22 and the rate of rotation of the body 10 by the mandrel 20 are adjusted so that a layer of the metal powder from the funnel member 22 of given thickness is deposited on the surface 12 of the body 10. The power level and cross-sectional dimensions of the beam 26 of coherent electromagnetic energy are adjusted so that impingement of such beam 26 on the layer of powdered metal deposited on the surface 12 will melt substantially all of such powder which will subsequently fuse into a solid mass as it is carried out from under impingement by the beam 26 by rotation of the body 10 and mandrel 20. Thus, one full rotation of the body 10 and mandrel 20 will be sufficient to provide a fused coating of the metal powder from the funnel member 22 on the surface 12 of the body 10.

According to this invention, the materials selected for the powdered metal article and the wear resistant surface as well as the power of the beam 26 and its cross-sectional dimensions, the quantity of metal powder deposited on the surface 12 by the funnel member 22 and the rate of rotation of the body 10 and the mandrel 20 result in a fused wear resistant coating which is firmly bonded to the surface 12 by a limited penetration of the metal of the wear resistant surface into the voids between the particles of powder of which the body 10 is made without excessive heating of the body 10 and without substantial alloying of the metal of the wear resistant surface 14 with such particles of the body 10. For example, according to one embodiment of this invention, the powdered metal body 10 was made by pressing and sintering a pre-alloyed powder having a particle size of 80–325 mesh and the following composition by percent:

| | |
|---|---|
| Iron | 95.00 min. |
| Nickel | 1.80 - 2.20 |
| Molybdenum | 0.30 - 0.70 |
| Copper | 1.50 max. |

-continued

| | |
|---|---|
| Carbon | 0.40 – 0.70 |
| Total other elements | 1.00 max. |

The above alloy has a melting temperature of about 1500° C and the powdered metal body made therefrom was sintered under pressure at about 870° C and tempered at 205° C after formation.

A powder of metal having a melting temperature of about 1400° C, a particle size of 50–100 mesh and the following composition by percent was introduced into the funnel member 22 for deposition on the surface 12 of the body 10:

| | |
|---|---|
| Carbon | 0.76 – 0.86 |
| Manganese | 0.20 – 0.60 |
| Phosphorus | 0.030 Max. |
| Sulfur | 0.030 Max. |
| Chromium | 10.00 – 21.00 |
| Silicon | 1.90 – 2.60 |
| Nickel | 1.00 – 1.60 |
| Iron | remainder |

The powdered metal body 10 was a right circular cylinder having an outer diameter of 1.8 inches (4.6 cm) and an inner diameter of 1.5 inches (4.3 cm) about 0.365 inches (0.93 cm) long and having a beveled surface 12 at one end extending at an angle of about 20° with respect to the axis thereof. The funnel member was located with respect to the surface 12 of the body 10 to deposit a layer of powdered metal on the surface 12 about 0.250 inch (0.63 cm) thick when the surface 12 was moved thereunder at a rate of about 25 to 30 inches (60 to 80 cm) per minute. A beam of coherent electromagnetic energy having a diameter of about ¼ inch (0.63 cm) and a beam power of 4–5 kilowatts was impinged on the layer of powdered metal immediately after it emerged from under funnel member 22.

Figure 4:
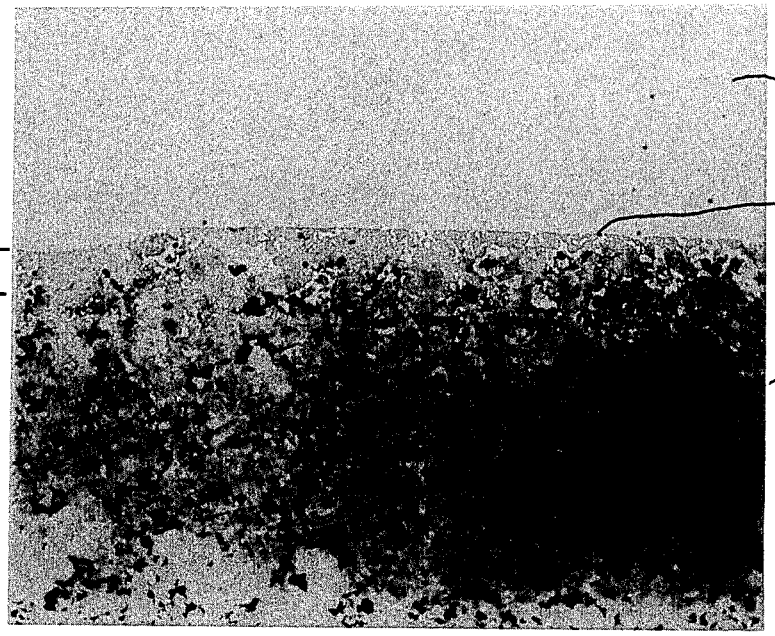
FIG. 4 is a photomicrograph taken at 100 times magnification of the interface between a powdered metal article having a wear resistant surface thereon in accordance with the teaching of this invention where a 1% Nital was used as the reagent in order to show the limited penetration of the wear-surface metal into the voids between the particles of the powdered metal substrate.

Referring to FIG. 4, a photomicrograph at 100 times magnification is shown of the resulting interface between the metal of the wear resistant surface 14 and the surface 12 of the body 10. The sample used in preparing the photomicrograph of FIG. 4 was treated with a 1% Nital etchant in order to reveal the penetration of the metal of the wear resistant surface into the voids between the particles of the powdered metal body 10. It was found that such penetration extended only for a depth of about 0.003 inch (0.0076 cm) 16 due to the minimal heating of the body 10 when the metal of the wear resistant surface was melted by the laser beam. The voids between the particles of the powdered metal body 10 are clearly visible in FIG. 4, and if the heating of the powdered metal body is not kept to a minimum, then there will be excessive penetration of the metal of the wear resistant surface into such voids due to the capillary action mentioned hereinabove and experienced in the prior art.

Figure 5:
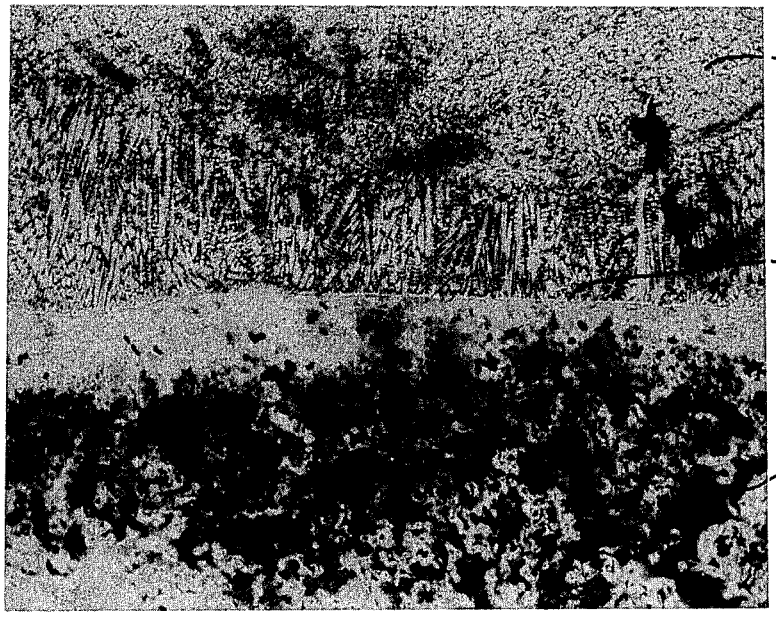
FIG. 5 is a photomicrograph taken at 100 times magnification substantially identical to that of FIG. 4 except that Kalling's reagent has been used to show the fine dendritic structure of the metal of the wear surface on the powdered metal article according to the teaching of this invention.

Referring to FIG. 5, a photomicrograph similar to that of FIG. 4 is shown in which the sample was treated with Kalling's reagent as an etchant in order to show the fine dendritic structure of the metal of the wear resistant surface. Again, the penetration of the metal of the wear resistant surface into the voids between the particles of the powdered metal body 10 is apparent. Also apparent in FIG. 5 is the well defined surface 12 of the powdered metal body 10 which confirms that no substantial alloying has occurred between the metal of the wear resistant surface 14 and the particles of the powdered metal body 10. The fine dendritic structure of the metal of the wear resistant surface is highly desirable since it will tend to contribute to the desired properties of the wear resistant surface including high hot hardness, resistance to "burning" (i.e., changes in physical characteristics at high temperature) and high resistance to thermal shock. Such fine dendritic structure is produced by the rapid melting and subsequent rapid cooling and solidification of the metal of the wear resistant surface.

It is believed that those skilled in the art will modify the specific embodiment of this invention as set forth hereinabove to suit specific applications for powdered metal articles having wear resistant surfaces without departing from the teaching of this invention. Although various combinations of materials could be used in making an article according to this invention, the specific embodiment disclosed herein has been found to be particularly desirable for use as a valve seat insert in diesel engines.

What is claimed is:

1. A metal article consisting of a body of a pressed, sintered and heat treated metallic powder of a first metal or metal alloy having a given melting temperature and a wear-surface of fused metal bonded to a surface of said body, said wear-surface having a fine dendritic structure and consisting of a second metal or metal alloy having a melting temperature approaching said given melting temperature of said first metal or metal alloy, said body having minute voids between the particles of said metallic powder and a portion of said fused metal of said wear-surface being received within said voids to a limited depth of not more than about 0.003 in (0.0076 cm) at said surface of said body without substantial alloying between said fused metal and said particles of said metallic powder.

2. A metal article as claimed in claim 1 wherein said first metal or metal alloy is at least 95% iron alloyed with about 2% nickel, about ½% molybdenum and about ½% carbon and said second metal or metal alloy is at least 73% iron alloyed with about 20% chromium, about 2½% silicon, about 1½% nickel, about ¾% carbon and about ½% manganese.

3. A metal article as claimed in claim 2 wherein said first metal or metal alloy includes not more than ½% copper and not more than 1% of all other elements and said second metal or metal alloy includes not more than 0.03% phosphorus and not more than 0.03% sulfur and essentially 0% of all other elements.

4. A metal article as claimed in claim 1 wherein said first metal or metal alloy has a melting temperature of about 1500° C and said second metal or metal alloy has a melting temperature of about 1400° C.

5. A metal article as claimed in claim 4 wherein said body of said first metal or metal alloy is a right circular cylinder having a beveled surface at one end thereof extending at an angle of about 20° with respect to the axis thereof and said wear-surface is bonded to said beveled surface at said one end of said right circular cylinder.

6. A metal article as claimed in claim 5 wherein said right circular cylinder has an outer diameter of about 1.8 inches, an inner diameter of about 1.5 inches and a length of about 0.36 inch, and said wear-surface has a thickness of about 0.25 inch with fused metal of said wear-surface received within voids in said body of said first metal or metal alloy to a depth of not more than about 0.003 inch below said beveled surface.

7. A metal article as claimed in claim 6 wherein said first metal or metal alloy is at least 95% iron alloyed with about 2% nickel, about ½% molybdenum, about ½% carbon, not more than ½% copper and not more than 1% of all other elements; and said second metal or metal alloy is at least 73% iron alloyed with about 20% chromium, about 2½% silicon, about 1½% nickel, about ¾% carbon, about ½% manganese, not more than 0.03% phosphorus, not more than 0.03% sulfur and essentially 0% of all other elements.

8. A metal article as claimed in claim 7 wherein about 90% of the particles of said metallic powder of said first metal or metal alloy which are sintered under pressure to form said body have particle sizes between about 80 mesh and about 325 mesh.

* * * * *